US011713708B2

(12) United States Patent
Petschenyk

(10) Patent No.: US 11,713,708 B2
(45) Date of Patent: Aug. 1, 2023

(54) DEGASSING APPARATUS

(71) Applicant: JAGUAR LAND ROVER LIMITED, Warwickshire (GB)

(72) Inventor: Oliver Petschenyk, Coventry (GB)

(73) Assignee: JAGUAR LAND ROVER LIMITED, Coventry (GB)

( * ) Notice: Subject to any disclaimer, the term of this patent is extended or adjusted under 35 U.S.C. 154(b) by 0 days.

(21) Appl. No.: 17/438,069

(22) PCT Filed: Mar. 4, 2020

(86) PCT No.: PCT/EP2020/055659
§ 371 (c)(1),
(2) Date: Sep. 10, 2021

(87) PCT Pub. No.: WO2020/182568
PCT Pub. Date: Sep. 17, 2020

(65) Prior Publication Data

US 2022/0018278 A1 Jan. 20, 2022

(30) Foreign Application Priority Data

Mar. 12, 2019 (GB) ..... 1903377

(51) Int. Cl.
*F01P 11/02* (2006.01)
*F01P 7/16* (2006.01)

(52) U.S. Cl.
CPC ..... *F01P 11/029* (2013.01); *F01P 7/165* (2013.01); *F01P 11/0214* (2013.01); *F01P 11/0285* (2013.01); *F01P 2011/0233* (2013.01)

(58) Field of Classification Search
CPC ..... F01P 11/029; F01P 3/02; F01P 11/028
See application file for complete search history.

(56) References Cited

U.S. PATENT DOCUMENTS 5,135,049 A * 8/1992 Attinger ..... F01P 11/029 165/104.32
5,456,218 A * 10/1995 Theorell ..... F01P 11/029 165/104.32

(Continued)

FOREIGN PATENT DOCUMENTS

DE 102015015198 A1 5/2017
EP 0213414 A1 3/1987

(Continued)

OTHER PUBLICATIONS

Combined Search and Examination Report under Sections 17 and 18(3) for Application No. GB1903377.8 dated Aug. 23, 2019.

(Continued)

*Primary Examiner* — Long T Tran
(74) *Attorney, Agent, or Firm* — Carlson, Gaskey & Olds, P.C.

(57) ABSTRACT

Aspects of the present invention relate to an apparatus comprising at least two chambers, each chamber comprising at least one wall defining the chamber, a fluid inlet and a fluid outlet through the wall of the chamber and an opening separate from the fluid inlet and fluid outlet. The fluid inlet and fluid outlet are configured such that a fluid enters the chamber via the fluid inlet and exits via the fluid outlet. A gas enters the chamber via the fluid inlet and exits the chamber via the opening, wherein the opening of each of the chambers is fluidly connected to a common fluid reservoir. The apparatus may be used for degassing multiple coolant circuits in a vehicle.

20 Claims, 8 Drawing Sheets

(56) References Cited

U.S. PATENT DOCUMENTS

| | | | | |
|---|---|---|---|---|
| 5,680,833 | A * | 10/1997 | Smith | F01P 11/029 165/104.32 |
| 6,216,646 | B1 * | 4/2001 | Smith | F01P 11/029 165/104.32 |
| 2006/0018067 | A1 * | 1/2006 | Vimercati | G11C 5/063 361/62 |
| 2008/0190385 | A1 * | 8/2008 | Bangert | F01P 11/029 123/41.44 |
| 2010/0089913 | A1 * | 4/2010 | Dexter | F01P 11/029 220/4.12 |
| 2012/0090348 | A1 | 4/2012 | O'Rourke et al. | |
| 2016/0169084 | A1 * | 6/2016 | Hügel | F01P 11/18 123/41.27 |
| 2016/0222869 | A1 * | 8/2016 | Nishiguchi | F01P 11/029 |
| 2018/0283261 | A1 * | 10/2018 | Morishita | F01P 11/029 |
| 2020/0009939 | A1 * | 1/2020 | Potticary | F25D 17/02 |
| 2020/0149463 | A1 * | 5/2020 | Trythall | B01D 36/001 |
| 2021/0207522 | A1 * | 7/2021 | Ayva | F01P 11/0204 |

FOREIGN PATENT DOCUMENTS

| | | | |
|---|---|---|---|
| GB | 2404640 | A | 2/2006 |
| JP | H10266856 | A | 10/1998 |
| WO | 03/042516 | A2 | 5/2003 |
| WO | 2010/059106 | A1 | 5/2010 |

OTHER PUBLICATIONS

International Search Report and Written Opinion of the International Searching Authority for International application No. PCT/EP2020/055659 dated Dec. 2, 2020.

* cited by examiner

DEGASSING APPARATUS

TECHNICAL FIELD

The present disclosure relates to an apparatus for degassing multiple fluid circuits, in particular an apparatus having multiple swirl pots for degassing separate coolant systems. Aspects of the invention relate to an apparatus, to a cooling system, and to a vehicle.

BACKGROUND

It is known to provide a device known as a swirl pot to remove air bubbles from vehicle coolant systems. A conventional swirl pot typically takes the form of a cylindrical chamber with a fluid inlet located near the top and a fluid outlet located near the bottom of the chamber. The inlet and outlet are arranged at such an angle that coolant entering the swirl pot is encouraged to follow a circular path around the outer wall of the pot, creating a downwards swirl. Through this motion, air bubbles are released which travel upwards to either a gap within the top of the swirl pot or out through an opening.

It is also known to provide expansion tanks to coolant systems. Typically an expansion tank is a tank fluidly connected in series with a coolant system. An air gap at the top of the expansion tank provides a space for the coolant to expand into, should it need to expand or contract with the varying temperatures the coolant will be at during periods of operation and disuse. Another purpose of many expansion tanks is as a refilling point, whereby more coolant can be added to the system via an opening in the top of the expansion tank. It is known to provide a single swirl pot in combination with an expansion tank. Typically the opening of the swirl pot is in fluid communication with the base of the expansion tank such that air bubbles released from a coolant system via the swirl pot are transferred to the expansion tank. This further removes the air from the coolant system. In some vehicles a number of such systems are required for different fluid systems operating at different temperatures and flow rates.

It is an aim of the present invention to improve on known devices and systems.

SUMMARY OF THE INVENTION

Aspects and embodiments of the invention provide an apparatus, a cooling system, and a vehicle as claimed in the appended claims.

A first aspect of the invention comprises an apparatus comprising: at least two chambers, each chamber comprising: at least one wall defining the chamber, a fluid inlet and a fluid outlet through the wall of the chamber, an opening separate from the fluid inlet and fluid outlet; wherein the fluid inlet and fluid outlet are configured such that a fluid enters the chamber via the fluid inlet and exits via the fluid outlet; wherein a gas enters the chamber via the fluid inlet and exits the chamber via the opening; wherein the opening of each of the chambers is fluidly connected to a common fluid reservoir. An advantage of this apparatus is that multiple degassing chambers (which may take the form of swirl pots) can be refilled from the same expansion tank, instead of requiring a dedicated expansion tank per each chamber.

In one embodiment, the at least two chambers comprise: a first chamber fluidly connected to a first fluid circuit; a second chamber fluidly connected to a second fluid circuit. The advantage of this is that multiple coolant systems can share and refill from a single expansion tank which facilitates manufacture by reducing the number of components. The fluid circuits may be fluidly decoupled from each other and comprise separate fluid conduits and associated fluidic systems connected to it (apart from the common fluid reservoir).

In another embodiment, the common fluid reservoir comprises a top portion; wherein the opening of the first chamber is closer to the top portion of the common fluid reservoir than the opening of the second chamber. The advantage of this is that space can be saved by having a particularly large chamber extend into the volume of the expansion tank rather than away from it. The overall integrated unit can remain the same size as one comprising smaller chambers when viewed externally. This would allow bigger chambers to be easily introduced into existing engine architectures designed for an integrated tank with smaller chambers.

In another embodiment, the opening of the second chamber fluidly connects to the base of the first chamber and the opening of the first chamber is fluidly connected to the fluid reservoir. This design can be advantageous over other designs depending upon the existing architecture within the vehicle. The taller, thinner design may be more compatible with some systems than alternative designs.

In another embodiment, the first and second chambers are each coupled to a base portion of the common fluid reservoir. It may be advantageous to have the chambers located beneath the common fluid reservoir to make it easier for the gas bubbles to evacuate upwards toward the common fluid reservoir. Having each chamber directly coupled to the common fluid reservoir provides the advantage of making it easier for the new coolant in the reservoir to reach the chambers.

In another embodiment, at least two of the chambers are different sizes. Allowing the chambers to be different sizes is advantageous as it allows multiple coolant systems with different flow rates to make use of the shared expansion tank. The flow rate of a coolant system determines the optimal swirl pot size to be used. Allowing chambers of different sizes therefore allows multiple coolant systems with different flow rates.

In another embodiment, the fluid inlet and the fluid outlet associated with any one of the chambers are arranged to connect to the chamber sidewall at tangential angles. The advantage of the fluid inlet and fluid outlet being connected to the sidewall at tangential angles is that it encourages the fluid to flow in a circular path inside the chamber.

In another embodiment, one or more of the chambers comprises an internal baffle system. This is an alternate chamber design to the tangential inlet example described above, the advantage of which is that the fluid inlet and fluid outlet connections do not need to be tangential to the chamber wall. As such, it can accommodate different vehicle architectures, allowing the inlet and outlet to be placed at any angle.

In another embodiment, the opening of at least one of the at least two chambers is located on a central axis running from the base to the top of the common fluid reservoir. The central axis may be the axis running from the base to the top of the fluid reservoir that is substantially equidistant from opposing sidewalls of the fluid reservoir. The common fluid reservoir may a substantially rectangular cross section. The rectangular cross section may have one major dimension longer than the other. The central axis may be the axis that is substantially equidistant between the reservoir walls at opposite ends of the wider dimension of the rectangular cross section. The advantage of an opening being located near this central axis is that it optimises fluid coverage of the opening when the apparatus is in use at an inclined angle. The most important coolant system can be prioritised over others by placing it nearer or covering the central axis.

In another embodiment, the openings of at least two of the at least two chambers are disposed either side of a central axis running from the base to the top of the common fluid reservoir. The advantage is that the openings are distributed along the base of the common fluid reservoir, with neither one being prioritised with a more central location. Fixing the connections to the base of the common fluid reservoir is advantageous for allowing gas bubbles to evacuate the chambers by travelling upwards. The relative position of the two chambers may be symmetrical about the tank central axis or asymmetrical. The symmetry of the relative positions may be with respect to any of: the relative position of the centre of the openings of the two chambers; the relative position of the nearest sidewalls of the chambers to the central axis; the relative positions of the edges of the openings of each chamber nearest the central axis.

In another embodiment, any one or more of the said chambers comprises a plurality of openings to the common fluid reservoir. The advantage of a plurality of openings is that one can be dedicated to evacuating the gas bubbles and another can be dedicated to allowing new coolant to flow in, rather than the two opposing flows competing at the same single opening. Alternatively, multiple openings could be advantageous if the coolant system is producing a very large amount of gas bubbles that need to be evacuated from the chamber quickly.

In another embodiment, the fluid circuits are for distributing coolant. The advantage is that the coolant circuit can make use of the apparatus to remove gas bubbles and replenish its supply of coolant.

In another embodiment wherein the apparatus comprises an expansion tank, the expansion tank comprises the fluid reservoir. The advantage of the fluid reservoir being an expansion tank is that it also allows room for the fluid to expand with heat variation whilst also providing a convenient point at which the system can be refilled with fluid.

In another embodiment, the expansion tank and chambers form an integrated tank. The advantage of the components being formed into a singular integrated tank is that it is easier to manufacture and introduces a standardised, uniform integrated unit that can be incorporated into multiple vehicle designs.

In another embodiment, the integrated tank comprises a base portion comprising the chambers and a reservoir portion comprising the expansion tank. As stated previously, it is advantageous to have the chambers comprise the base portion of the integrated tank as it makes it easier for the gas bubbles to rise upwards and evacuate the chambers into the common fluid reservoir which comprises the expansion tank.

In another embodiment, each of the chambers comprises an end wall having the respective opening, each respective end wall forming part of the expansion tank. This provides an advantage regarding the strength of the integrated tank. Instead of multiple tanks connected through conduits, having the end wall of the chamber forming part of the expansion tank results in a sturdier apparatus and provides a more direct link between the chamber and the expansion tank.

Another embodiment comprises a cooling system comprising the apparatus of any of the above embodiments and at least one pump to pump fluid around at least one fluid circuit.

A second aspect of the invention comprises a vehicle comprising the cooling system of the previous embodiment. The advantage of a vehicle comprising such a cooling system is that the various sub-systems serviced by the cooling system will operate at greater efficiency, increasing the overall efficiency of the vehicle.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 1:
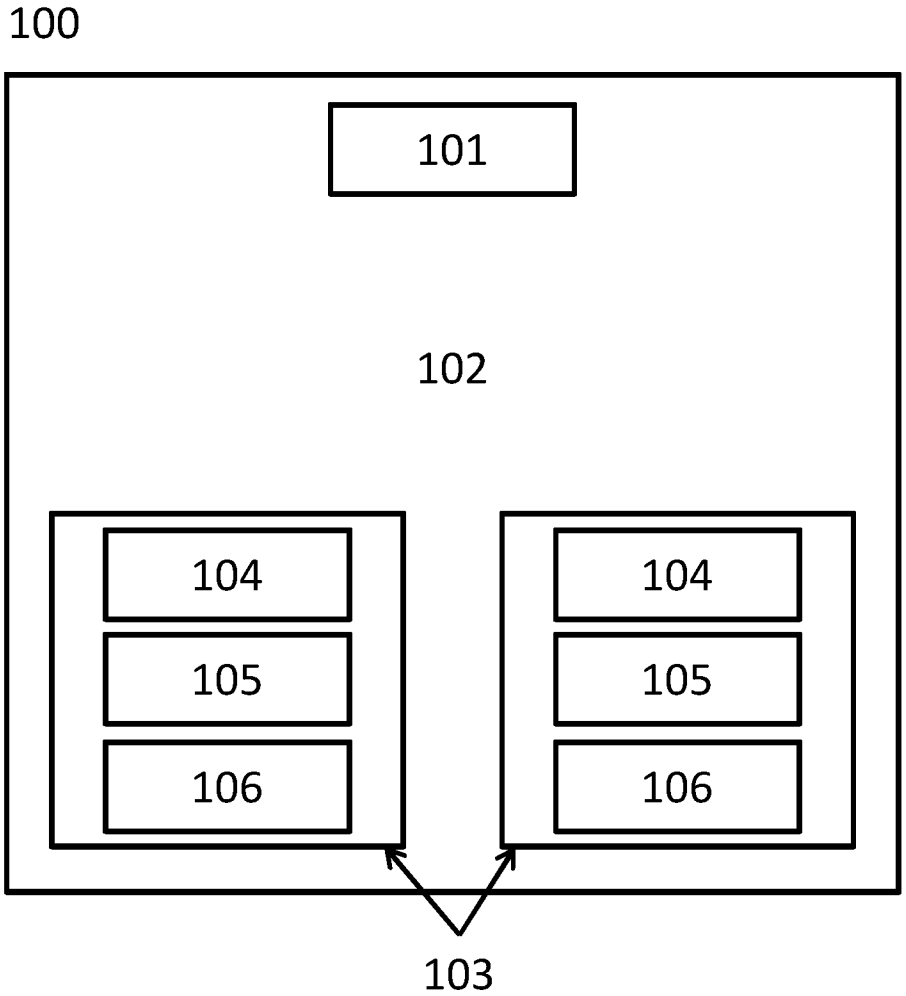
FIG. 1 shows a block diagram representation of the apparatus in a first embodiment.

There is presented an apparatus for removing gas from a fluidic system. An example of such an apparatus is shown in the block diagram of FIG. 1. The apparatus 100 comprises two chambers 103. Each chamber 103 comprises: at least one wall defining the chamber; a fluid inlet 105 and a fluid outlet 106 through the at least one wall of the chamber 103 and an opening 104 separate from the fluid inlet 105 and fluid outlet 106. The fluid inlet 105 and fluid outlet 106 are configured such that a fluid enters the chamber 103 via the fluid inlet 105 and exits via the fluid outlet 106. A gas enters the chamber 103 via the fluid inlet 105 and exits the chamber via the opening 104. The opening 104 of each of the chambers 103 is fluidly connected to a common fluid reservoir 102. The common fluid reservoir 102 comprises a sealable opening 101 through which fluid can be added.

The advantage of this apparatus is that the common fluid reservoir 102 acts as an expansion tank for two different fluid systems that contain the same fluid. For example, the apparatus 102 would allow the common fluid reservoir to cater to two coolant systems within a vehicle, provided that both systems use the same type of coolant. These systems may be coolant for a battery, a combustion engine or a climate control system. The systems may also be running at different temperatures and flow rates. Even though both chambers 103 are fluidly connected to the common fluid reservoir 102, it has been identified that the coolant contained within each chamber 103 is very unlikely to mix due to the internal flow paths of the fluid within the chambers 103. The flow of coolant out of the opening 104 into the reservoir 102 is not substantial but still allows for gas to rise out and for replacement coolant to enter. Using a common reservoir 102, for example a common expansion tank, reduces the number of components required to provide multiple fluidic systems that require a degassing operation, thereby facilitating manufacture. It also reduces the time required for service due to the reduction in the number of reservoirs.

An apparatus in accordance with an embodiment of the present invention is described herein with reference to the accompanying FIGS. 2A to 2D. The apparatus shown in these figures and described below is for a vehicle. In particular, the apparatus is used for degassing two coolant systems using two swirl pot type chambers 210, 211 fluidly connected to a fluid reservoir 203 in the form of an expansion tank. It is envisaged that the apparatus may be used for other systems or other vehicle types and for other fluid types other than coolants.

Figure 2A:
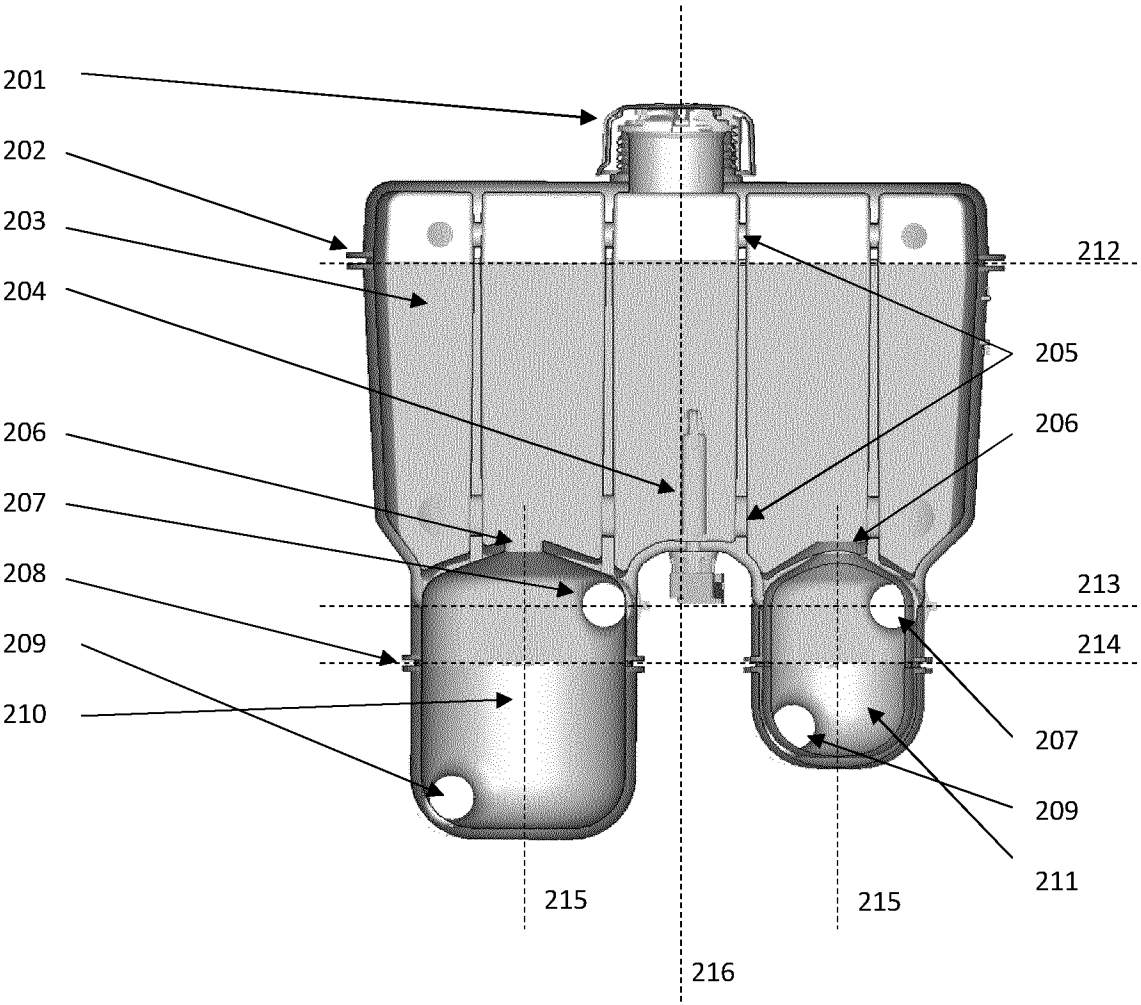
FIG. 2A shows a front view schematic representation of the apparatus in a second embodiment, showing two chambers of different sizes connected to a common fluid reservoir.

With reference to FIG. 2A, the apparatus contains two chambers 210, 211 connected at the base of a common fluid reservoir 203. Alternatively, the apparatus may comprise more than two chambers. These chambers 210, 211 may be referred to as swirl pots for purposes of discussing the apparatus herein. A swirl pot is a type of degas chamber designed to allow fluid to flow in a downward circular path with the aim of encouraging gas pockets to collect near the centre of the circular flow path. These gas pockets then proceed to rise upwards out of the swirl pot 210, 211, thus removing them from the fluid before the fluid exits the swirl pot 210, 211 and continues along a fluid circuit. Other degas chambers instead of swirl pots could be used. For example a degas chamber having an internal baffle that helps remove gas bubbles. Such baffle-type chambers may not require the incoming fluid to be encouraged to circulate around the chamber.

Each chamber 210, 211 in this example has a sidewall and two opposing ends. One of the ends of each chamber 210, 211 has an opening 206 that allows gas to pass from the chamber 210, 211 into the common fluid reservoir 203, which in this example is a tank with a base and a top. The top of the tank has a sealable opening 201. At least a portion of each chamber sidewall extends outwardly and away from the base of the tank such that the other of the ends of each chamber resides distal from the tank top and base.

The sidewall of each chamber 210, 211 has a fluid inlet 207 located at a first position on the sidewall and a fluid outlet 209 located at a second position on the sidewall that is different to the first position. Fluid entering the chamber flows into the chamber 210, 211 and out of the chamber 210, 211 through respective inlet 207 and outlet 209 conduits at different positions. The choice of the locations of the fluid inlets 207 and outlets 209, together with angles that the longitudinal axes of the conduits make on joining the sidewall help determine the direction of the flow of the fluid in the chamber 210, 211.

The chambers 210, 211 may take on a wide range of designs. All feature a fluid inlet 207 and a fluid outlet 209. Instead of angling the fluid inlet 207 and the fluid outlet 209 to encourage a circular motion, an internal structure such as a baffle may be used. Regardless of angle of entry, a baffle may be engineered to agitate the fluid and alleviate gas bubbles upwards and through the opening 206 into the fluid reservoir 203.

The chambers (or swirl pots) 210, 211 in FIGS. 2A-2D are predominantly cylindrical in shape with one cylindrical end proximal to the reservoir and the other cylindrical end distal from the reservoir. The cylinder ends have rounded edges where each end of the cylinder joins the curved sidewall of the cylinder. The end face that is distal from the reservoir, in this example, remains flat up to a point where the rounded edge begins to join the face to the wall. This end face may be referred to as the bottom of the swirl pot 210, 211. The other end at the top of the swirl pot has a frustoconical shape. This may be referred to as the frustoconical end portion. The larger radial edge of the frustrated cone is adjacent to the sidewall and the narrower edge of the frustrated cone forms the opening 206. The frustoconical shape helps to funnel the gas rising through the chamber 210, 211 through the opening 206 into the expansion tank 203. The advantage of this is that gas pockets will not collect at the top of the chamber 210, 211 and will be encouraged to leave, simultaneously causing replacement fluid to flow in.

The interior top face of the chamber 210, 211 is the interior face of the frustrated cone. An imaginary line running through the centre of the bottom and the top of each swirl pot shall be referred to as the swirl pot's central axis 215. In this example the central axis 215 of each chamber 210, 211 also passes through the central axis of the frustoconical end portion. Alternatively, the chambers 210, 211 may be different shapes. For example, both ends of each chamber 210, 211 may have substantially flat faces residing perpendicular to the sidewall.

As shown in FIG. 2A, the swirl pots 210, 211 are different sizes. In FIG. 2A one swirl pot is larger than the other by having a wider radial width and a longer sidewall that extends away from the base of the expansion tank 203. The size of a swirl pot 210, 211 is typically dependent upon the flow rate of the fluid intending to pass through it. The swirl pots 210, 211 may also be the same size. Each swirl pot 210, 211 comprises a fluid inlet 207 located in the sidewall of the swirl pot near the top, a fluid outlet 209 located in the sidewall of the swirl pot near the bottom and an opening 206 located in the top of the swirl pot 210, 211, preferably in a central position such that the inverted frustrated cone face on the inside of the swirl pot 210, 211 leads toward the opening 206. Put another way the fluid inlet 207 is spaced from the fluid outlet 209 in the vertical direction such that the fluid inlet 207 and the fluid outlet 209 are at different heights. Typically the inlet is located above the outlet. For purposes of discussing these examples, the 'bottom' of the swirl pot corresponds to the portion of the swirl pot furthest away from the expansion tank and the 'top' of the swirl pot is the portion of the swirl pot closest to the expansion tank. The opening 206 provides a fluid connection between the swirl pot(s) 210, 211 and the common fluid reservoir 203. The fluid inlet 207, fluid outlet 209 and opening 206 may be situated elsewhere on the chamber 210, 211, for example in different positions on the sidewall or on an end face.

Figure 2B:
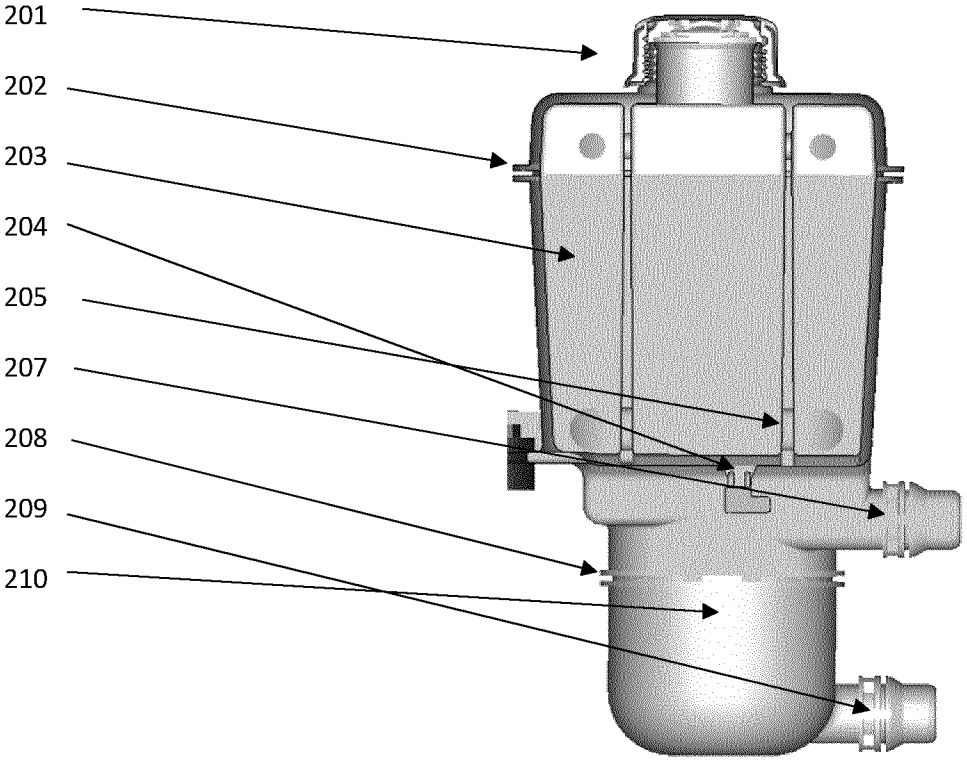
FIG. 2B shows the embodiment as shown in FIG. 2A from a side view.
Figure 2C:
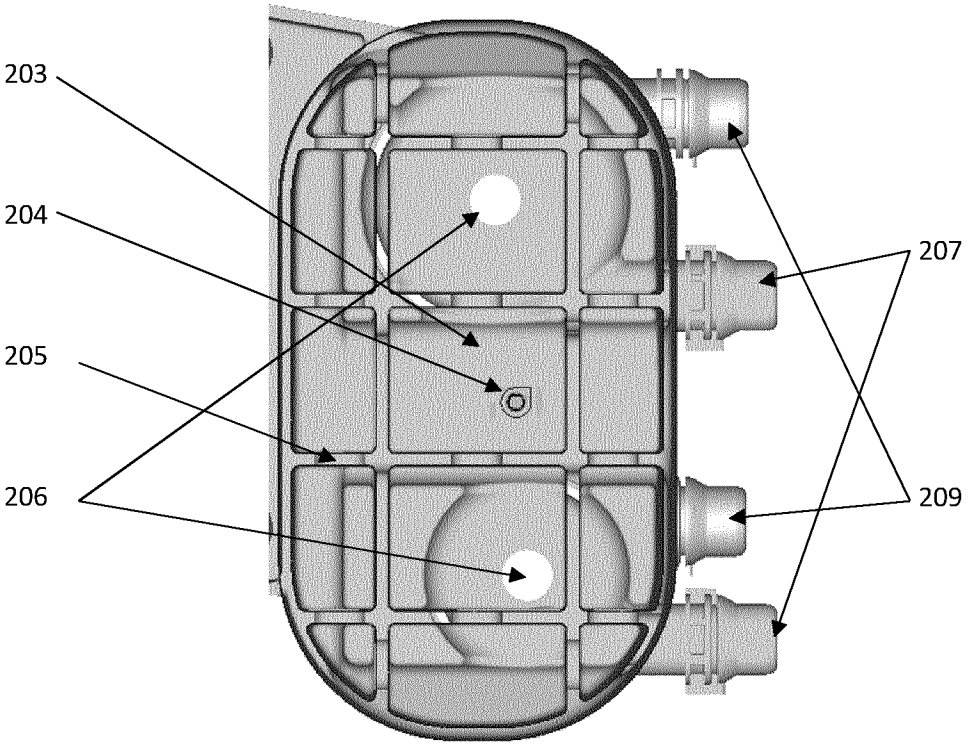
FIG. 2C shows a cross-section of the embodiment as shown in FIG. 2A, the cross-section intersecting the system at line 212.
Figure 2D:
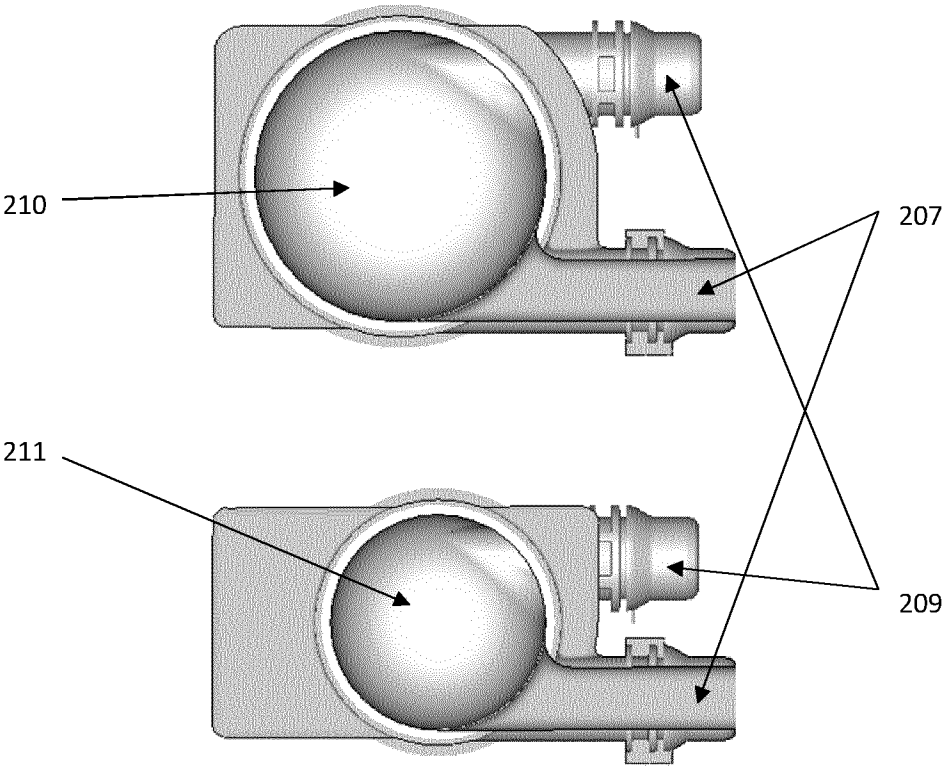
FIG. 2D shows the a cross-section of the embodiment as shown in FIG. 2A, the cross-section intersecting the system at line 213.

The common fluid reservoir 203 is approximately box shaped comprising six rectangular faces. All edges of the box are rounded, resulting in no sharp edges. One pair of opposing faces is larger than the other pairs of opposing faces. These faces shall be referred to as the front and the back of the common fluid reservoir 203. The faces in the embodiment shown in FIG. 2A comprise a pair of opposing edges longer than the perpendicular pair of opposing edges. The opposing faces of the common fluid reservoir 203 which connect to the shorter edges of the front and the back of the common fluid reservoir 203 shall be referred to as the sides of the common fluid reservoir 203. The curvature of the rounded edges joining the sides to the front and the back comprise a much larger radius of curvature than the other tighter rounded edges of the common fluid reservoir 203, such that the side faces are almost lost where the curves on either side meet, resulting in sides that appear to be near half-cylindrical as seen in FIG. 2C. The remaining pair of opposing faces of the common fluid reservoir 203 which connect to the longer edges of the front and the back of the common fluid reservoir 203 are referred to as the top and base of the common fluid reservoir 203.

The top may comprise a sealable opening 201, through which fluid can be added. FIGS. 2A and 2B show the sealable opening 201 as comprising a screw cap. Sealable opening 201 may take the form of any sealable opening, including but not limited to a snap on lid or a fitted bung. The sealable opening 201 in FIGS. 2A and 2B is located in the centre of the top of the common fluid reservoir 203. The width and height of the common fluid reservoir 203 are set by the longer and shorter edges of the face of the common fluid reservoir 203 respectively. The depth of the common fluid reservoir 203 is set by the separation between the front and the back. In this example, the depth is shorter than both the width and the height, but is larger than the diameter of the larger of the two swirl pots 210, 211. An imaginary line running through the centre of the base and the top of the common fluid reservoir shall be referred to as the common fluid reservoir's central axis 216 and referred to later herein. Alternatively, the common fluid reservoir 203 may take a different shape for the sake of convenience or aesthetic requirements. The common fluid reservoir 203 acts as an expansion tank for the plurality of connected swirl pots 210, 211.

The tops of the swirl pots 210, 211 that contain the openings 206 form part of the base of the common fluid reservoir 203. The swirl pots 210, 211 intersect the base of the common fluid reservoir 203 at the join between the swirl pot wall and the swirl pot top such that the conical shape of the swirl pot top extends into the volume of the common fluid reservoir 203. As such, the openings 206 provide a fluid connection between the swirl pots 210, 211 and the common fluid reservoir 203. The swirl pots 210, 211 are located side by side along the direction of the width of the common fluid reservoir 203, but having a gap in between them.

The apparatus may comprise a fluid level sensor 204 as shown in FIG. 2. An end of the fluid level sensor 204 may reside in the gap between the swirl pots 210, 211. A portion of the fluid level sensor 204 extends outwardly from the base of the tank whilst another portion extends through an aperture in the tank base and into the fluid reservoir 203.

Alternatively, either of the swirl pots 210, 211 could be intersected by the base of the common fluid reservoir 203 at a position along the sidewall of the swirl pot. The resulting structure would include a cylindrical portion and an end of the swirl pot wall extending into the tank and falling within the volume of the common fluid reservoir 203. This may result in the openings 206 of the two swirl pots 210, 211 not being horizontally aligned with one another, with one being closer to the top of the common fluid reservoir 203 than the other.

Either of the swirl pots 210, 211 may alternatively have its corresponding opening 206 aligned with the central axis 216 of the common fluid reservoir 203. This configuration would allow for maximum fluid coverage of the opening 206, should the fluid level move or change if the device is used at an inclined angle as opposed to when the vehicle resides flat with respect to the surface of the Earth.

A further alternative may present the plurality of swirl pots 210, 211 and the common fluid reservoir 203 as separate units, not as a singular integrated system. The opening 206 may be connected to tubing which bridges a fluid connection between the swirl pot and the common fluid reservoir to allow gas pockets to evacuate the swirl pot. Similarly, an additional tube could be used to refill the swirl pot with displaced fluid from the common fluid reservoir.

The common fluid reservoir 203 may further comprise an internal baffle system 205. The advantage of having a baffle system 205 is that it prevents fluid contained within a volume from sloshing erratically when the volume is moved. As a result, when the fluid level is low, it will also help maximise fluid coverage of the openings 206. The internal baffle system 205 may comprise one or more dividing walls that split the internal volume into a plurality of sections. FIG. 2C depicts two equally spaced dividing walls inside the expansion volume parallel to the front and back of the common fluid reservoir 203. A further four equally spaced dividing walls perpendicularly intersect the previously mentioned two walls, parallel to the sides of the common fluid reservoir 203, resulting in 15 sections. All sections are fluidly connected to one another through a series of holes in the baffle 205. Each internal dividing wall that comprises the baffle contains two holes 205, one near the top of the common fluid reservoir and one near the base of the common fluid reservoir. The baffle system 205 may take the form of any obstruction within the volume of the common fluid reservoir that will disturb internal flow but maintains fluid connectivity between all parts of the volume.

The fluid level sensor 204 is shown in FIGS. 2A and 2C as being in the centre of the base of the common fluid reservoir 203, located between the two swirl pot openings 206 and extends upwards into the middle of the common fluid reservoir 203. The fluid level sensor 204 may alternatively be located anywhere inside of the common fluid reservoir 203.

Figure 3:
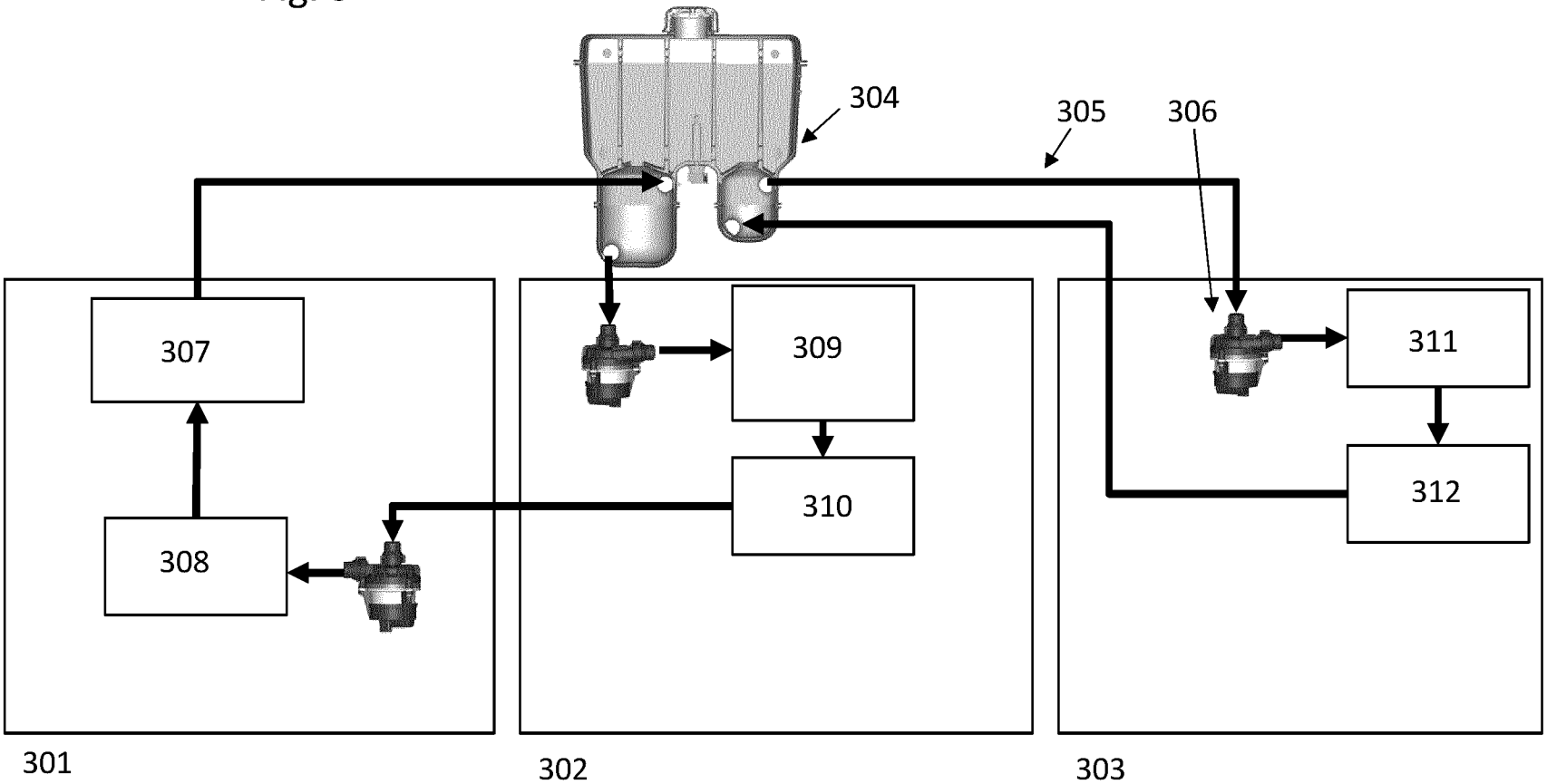
FIG. 3 shows an example of the apparatus of FIG. 2A connected to multiple cooling systems.

The fluid inlet 207 and fluid outlet 209 of the first and second swirl pots 210, 211 provide fluid connections to a first and second fluid circuit respectively (not shown in FIGS. 2A-D, example shown in FIG. 3). The fluid inlet 207 and fluid outlet 209 connect to the walls of the swirl pots via respective conduits at tangential angles to encourage a swirling motion as fluid enters the swirl pot 210, 211. Fluid is pumped around the fluid circuits and enters the swirl pot 210, 211 through the fluid inlet 207. The tangential angle of entry means that the flow of fluid immediately makes contact with the curved wall at a shallow angle, redirecting the flow into a circular path. In use, the top of the swirl pot is located at a position of higher gravitational potential energy than the bottom of the swirl pot. The negative pressure of the fluid outlet 209 drives the coolant downwards. The fluid outlet is placed near the bottom of the swirl pot 210, 211 in order to encourage more air to escape before the coolant reaches the bottom and exits via the outlet 209. The result is a swirling fluid flow path inside the swirl pot 210, 211. Upon reaching the bottom, the tangential angle of the fluid outlet 209 is positioned in such a way in order to generate more motion. Alternatively, the fluid outlet 209 could be located in other positions about the swirl pot 210, 211, for example in the base of the swirl pot 210, 211 in order to achieve a greater height differential between the fluid inlet 207 and fluid outlet 209.

This fluid flow path is desirable as the swirling motion encourages any pockets of gas contained within the fluid to collect in the centre of the swirling fluid. Differences in density between the gas pockets and the surrounding fluid will allow the gas pockets to drift upwards towards the top of the swirl pot when in use. The gas pockets are encouraged towards the opening 206 by the inverted cone shape of the inner face of the top of the swirl pot. Gas pockets exit the swirl pot 210, 211 through the opening 206 and enter the common fluid reservoir 203, where they continue to drift upwards toward the top of the common fluid reservoir 203.

The common fluid reservoir 203 when in use has an optimal fill level allowing an air gap at the top of the volume inside the common fluid reservoir 203. Gas pockets which reach the top of the common fluid reservoir 203 merge with the air pocket. In many examples of fluid flow circuits, the removal of unwanted gas pockets is desirable. The escaping gas pocket from the swirl pot 210, 211 is displaced by more fluid from the common fluid reservoir 203 via the same opening 206. As such, the fluid circuits connected to either swirl pot 210, 211 are both replenished by new fluid from the shared common fluid reservoir 203.

Alternatively, the swirl pot 210, 211 could contain a plurality of openings 206. This could potentially allow for an uninterrupted flow of replacement fluid through one opening and the evacuation of gas pockets through another opening.

In further alternate embodiments, the swirling path of the fluid within the swirl pot could be replaced by a baffle system internal to a degas chamber, agitating the fluid without the need to position a fluid inlet 207 and a fluid outlet 209 at tangential angles.

FIGS. 2A and 2B also depict heat welds 202, 208 which are used in the construction of the fluid common reservoir 203 and swirl pots 210, 211. As seen in FIG. 2A, the main body of the integrated system may be comprised of three initially separated portions, as indicated by lines 212 and 214. The portions are joined by the heat welds 202, 208, however alternate methods of joining the portions include but are not limited to: an adhesive, a clipping mechanism or a rubber friction seal. A modular method of production provides the advantage of enabling the sizes of the common fluid reservoir 203 and the swirls pots 210, 211 to be customised easily, whilst still using a common central portion (defined as the portion between lines 212 and 214). Alternatively, any combination of the above portions could be formed together, creating fewer portions that require assembly. The entire integrated system may be formed as a single unit with no assembly required.

The common fluid reservoir 203 and swirl pots 210, 211 are preferably made from a solid and rigid non-porous material, ideally but not limited to plastic. Alternatively, the common fluid reservoir 203 and swirl pots 210, 211 could be made out of metal.

In a preferred embodiment, the fluid is a coolant. This coolant may be but is not limited to water or a glycerol solution. In a preferred embodiment, the previously mentioned fluid circuits comprise coolant systems inside a vehicle. Coolant systems within a vehicle may service a wide range of systems and components within the vehicle. These include but are not limited to engines, electric drive units (EDUs), battery circuits and climate circuits.

FIG. 3 shows the integrated system 304 (as shown in FIG. 2A) as a shared component of multiple fluid circuits 301, 302, 303. Pumps 306 drive the fluid around the circuits in pipes 305. In this example, the fluid circuits 301, 302, 303 are coolant systems in a vehicle. The electric drive unit (EDU) coolant fluid circuit 301 and the battery coolant fluid circuit 302 are connected in series with the larger swirl pot in the integrated tank system 304.

The circuit 301 comprises a radiator 307 and an EDU 308, and typically operates between the temperatures of 20-40 degrees C., and has a typical flow rate of 40 L/min. The circuit 302 comprises a heater/chiller system 309 and a battery 310, and typically operates between the temperatures of 20-40 degrees C., and at a typical flow rate of 40 L/min. The circuit 303 comprises a heater 311 and a HVAC system 312, and typically operates temperatures of over 70 degrees C., and at a typical flow rate of 20 L/min. The circuits 301, 302, 303 may in principle have different components as described above and/or fewer or lesser components.

As both the EDU coolant fluid circuit 301 and the battery coolant fluid circuit 302 operate at the same flow rate and temperature range, they may share a circuit and therefore share a swirl pot. The climate coolant fluid circuit 303 operates at a different flow rate and temperature range than the other coolant fluid circuits 301, 302. As such, it cannot be connected in series and uses a separate swirl pot in the integrated tank system 304. The lower flow rate necessitates the use of a smaller swirl pot.

A system like that depicted in FIG. 3 demonstrates the usefulness of the claimed apparatus. The coolant from fluid circuits 301 and 302 will not mix with the coolant from fluid circuit 303 inside the integrated tank system. The coolant will enter the swirl pot through the fluid inlet 207, swirl around the inside of the swirl pot and exit via the fluid outlet 209. Confined to this path by fluid dynamics, very little of the coolant will exit the swirl pot 210, 211 and enter the common fluid reservoir 203 via the opening 206. This entails that high temperature coolant of one fluid system does not adversely heat the coolant in the swirl pot of the over fluid system. Gas pockets in the coolant system exit the swirl pot 210, 211 via this opening 206. The exiting gas is displaced by replacement coolant which will flow into the swirl pot 210, 211 from the common fluid reservoir 203 via the opening 206. Instead of having a swirl pot and an expansion tank for each fluid circuit operating at different flow rates and temperatures, the claimed apparatus allows for multiple fluid circuits to share one common expansion tank. All coolant systems can be refilled from the shared common fluid reservoir 203.

Figure 4:
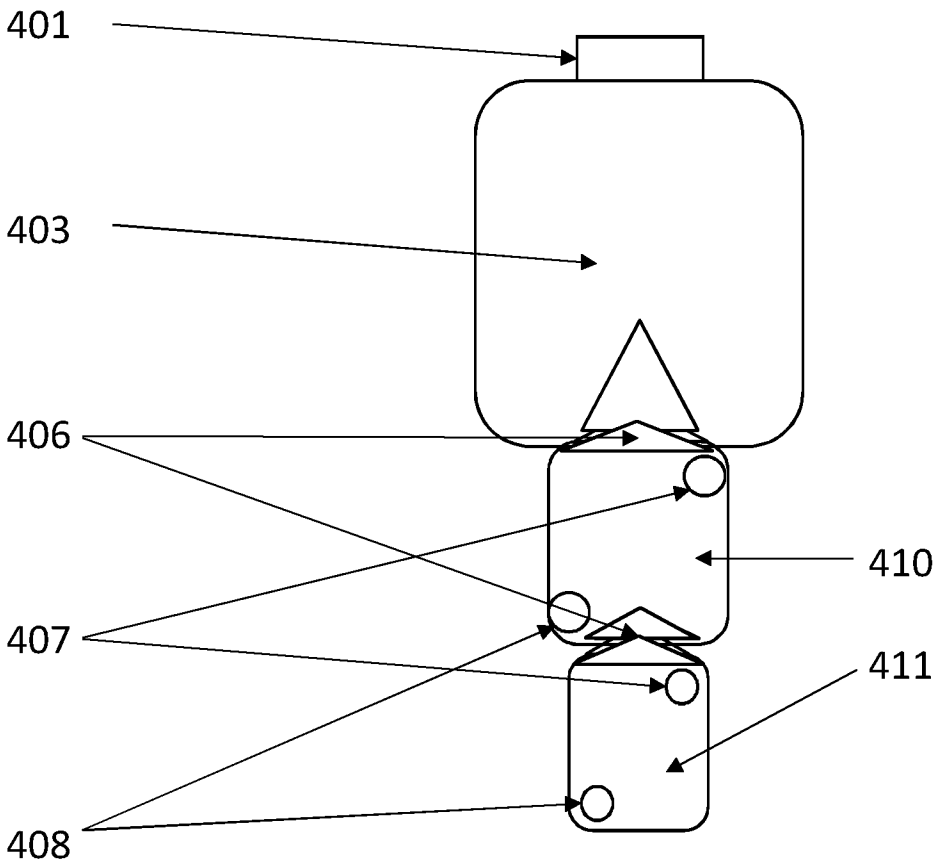
FIG. 4 shows a schematic representation of the apparatus in a third embodiment wherein a first chamber is fluidly connected to the base of a second chamber, which in turn is fluidly connected to the common fluid reservoir.

FIG. 4 shows an alternate embodiment wherein swirl pots are in a stacked configuration. The opening 406 of a second chamber (or swirl pot) 411 is fluidly connected to the base of a first chamber 410. As in previous embodiments, the opening 406 of the first chamber 410 is fluidly connected to the base of the common fluid reservoir 403 and each swirl pot has a fluid inlet 407 and a fluid outlet 408. In this configuration, the system is still able to keep the two fluid circuits separated whilst providing for gas bubbles to escape into the common fluid reservoir 403. In this example, the second chamber 411 would refill any displaced gas pockets with coolant from the first chamber 410, which in turn would refill from the common fluid reservoir 403. The common fluid reservoir 403 comprises a sealable opening 401. Alternatively, either swirl pot 410, 411 could have a tube connecting the base of the respective swirl pot 410, 411 to the fluid reservoir 403. These tubes would allow coolant to flow from the fluid reservoir 403 into the swirl pots 410, 411 near their base whilst air could escape through the opening 406. For example, the second swirl pot 411 may have a tube connecting the base of the second swirl pot 411 at or near the base of the common fluid reservoir 403. This allows fluid from the common fluid reservoir 403 to flow down the tube to refill the second swirl pot 411.

In another configuration (not shown) any one or more of the chambers may be contained entirely within the expansion tank such that no portion of the chamber extends outwardly from the peripheral walls of the tank. Additionally or alternatively any one or more of the chambers may be coupled to other wall external sections of the tank. For example a chamber may be coupled to a tank side wall extending from the base to the top of the tank. In this example the top of the chamber may have a slanted top portion extending upwardly towards the tank side wall wherein the opening of the chamber (fluidly connecting the chamber to the tank) is made through the chamber sidewall and tank sidewall. Gas pockets released from fluid entering the side mounted chamber therefore flow upwards, hit the sloped top and are encouraged to progress towards the opening.

Figure 5:
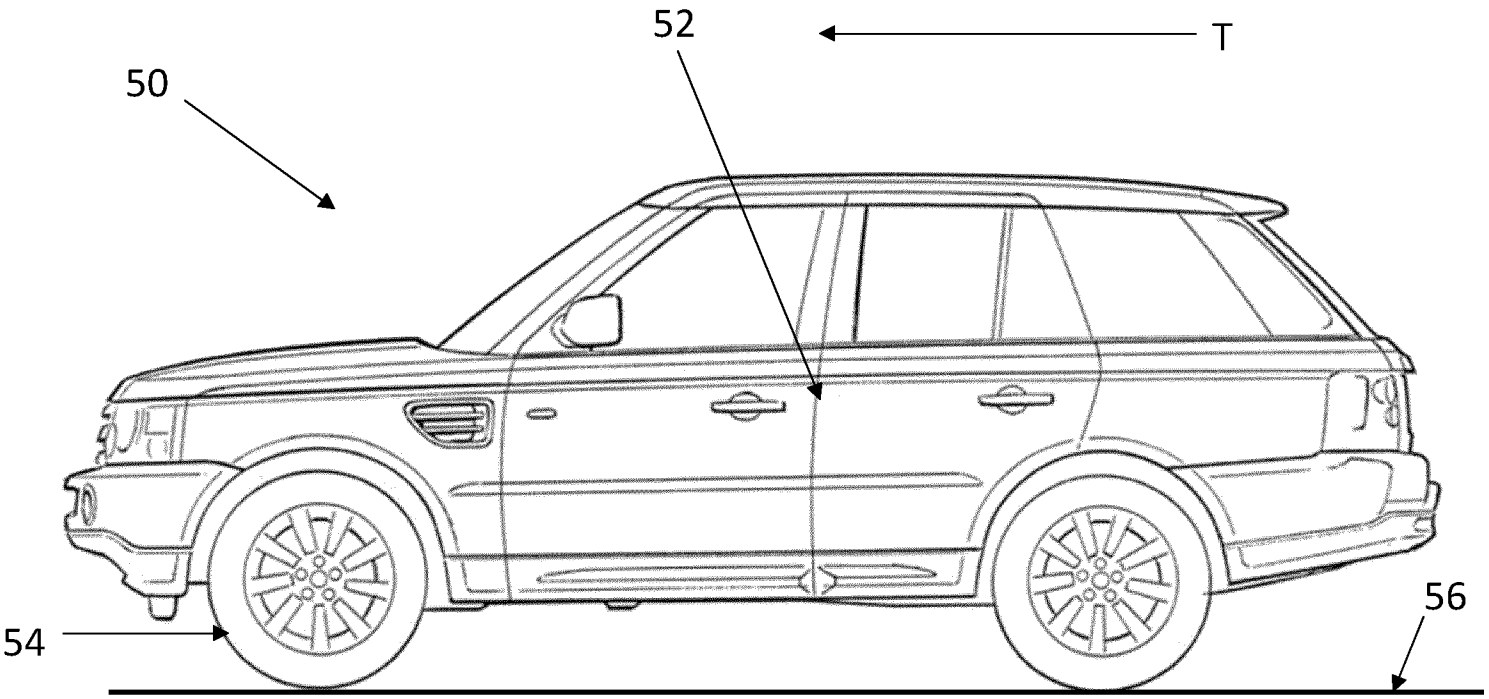
FIG. 5 shows a vehicle in accordance with an embodiment of the invention.

FIG. 5 illustrates in side view a vehicle 50 to which embodiments of the invention may be applied. For example the apparatus may be located in an engine compartment, or other compartment of the vehicle 50 and connected to fluidic systems as shown in FIG. 3. The vehicle 50 has a vehicle body 52 supported on a plurality of wheels 54. A vehicle cabin is defined within the vehicle body 52 within which passengers of the vehicle 50 can be accommodated. In use, rotation of the wheels 54 by a motive source such as an engine causes the vehicle 50 to move, mainly in the forward direction of travel, indicated in FIG. 5 by the arrow T. Of course, it will be appreciated that the vehicle 50 can also be caused to move in the opposite direction to the arrow T, when in a reverse gear. A lower surface of the vehicle is closer to the ground 56 than an upper surface of the vehicle when the vehicle is supported by the wheels. The ground 56 may be used as a reference point as shown in FIG. 5.

The vehicle 50 shown in FIG. 5 may be an autonomous vehicle, for example a self-driving car. It is noted, however, that embodiments of the present disclosure find application in conventional vehicles also, as mentioned above.

It should be appreciated that the term 'vehicle' may include but is not limited to a land vehicle, watercraft or aircraft. The vehicle may be a transport vehicle for transporting people and/or cargo. The vehicle may be any of a wheeled, tracked, or skied vehicle. The vehicle may be a motor vehicle including but not limited to, a car, a lorry, a motorbike, a van, a bus, a coach.

It will be appreciated that various changes and modifications can be made to the present invention without departing from the scope of the present application.

The invention claimed is:

1. An apparatus comprising at least two chambers, each chamber comprising:

at least one wall defining the chamber, a fluid inlet and a fluid outlet through the wall of the chamber, and an opening separate from the fluid inlet and fluid outlet;

wherein the fluid inlet and fluid outlet are configured such that a fluid enters the chamber via the fluid inlet and exits via the fluid outlet, a gas enters the chamber via the fluid inlet and exits the chamber via the opening, the opening of each of the chambers is fluidly connected to a common fluid reservoir, a first chamber of the at least two chambers is fluidly connected to a first fluid circuit, a second chamber of the at least two chambers is fluidly connected to a second fluid circuit, the common fluid reservoir comprises a top portion, and the opening of the first chamber is closer to the top portion of the common fluid reservoir than the opening of the second chamber.

2. The apparatus of claim 1, wherein the opening of the second chamber fluidly connects to a base of the first chamber and the opening of the first chamber is fluidly connected to the common fluid reservoir.

3. The apparatus of claim 1, wherein the first and second chambers are each coupled to a base portion of the common fluid reservoir and are each fluidly connected to the common fluid reservoir.

4. The apparatus of claim 1, wherein the fluid inlet and the fluid outlet associated with any one of the chambers are arranged to connect to the chamber sidewall at tangential angles.

5. The apparatus of claim 1, wherein one or more of the chambers comprises an internal baffle system.

6. The apparatus of claim 1, wherein the opening of at least one of the at least two chambers is located on a central axis running from a base to a top of the common fluid reservoir.

7. The apparatus of claim 1, wherein the openings of the at least two chambers are disposed on either side of a central axis running from a base to a top of the common fluid reservoir.

8. The apparatus of claim 1, wherein at least one of the first or second chamber comprises a plurality of openings to the common fluid reservoir.

9. The apparatus of claim 1, comprising an expansion tank and wherein the expansion tank includes the fluid reservoir.

10. The apparatus of claim 9, wherein the expansion tank and the at least two chambers form an integrated tank.

11. The apparatus of claim 10, wherein the integrated tank comprises a base portion comprising the at least two chambers and a reservoir portion comprising the expansion tank.

12. The apparatus of claim 9, wherein each of the at least two chambers comprises an end wall having the respective opening, and each respective end wall forms part of the expansion tank.

13. The apparatus of claim 1, wherein at least one of the chambers has a size that is different than a size of at least one others of the chambers.

14. A cooling system comprising the apparatus of claim 1 and at least one pump to pump fluid around at least one fluid circuit.

15. A vehicle comprising the cooling system of claim 14.

16. The apparatus of claim 1, wherein when a liquid is present in the common reservoir, a first vertical distance measured along a vertical direction from the opening of the first chamber to a fill line of the liquid in the common fluid reservoir is greater than a second vertical distance along the vertical direction from the opening of the second chamber to the fill line.

17. The apparatus of claim 1, wherein the first chamber has a first side adjacent the common fluid reservoir, the opening of the first chamber is situated in the first side of the first chamber, the first chamber has a second side opposite from the first side and distal from the common fluid reservoir, and the opening of the second chamber is situated in a side of the second chamber that is adjacent the second side of the first chamber.

18. The apparatus of claim 17, wherein the opening of the first chamber is a first distance from the top portion of the common reservoir, the opening of the second chamber is a second distance from the top portion of the common reservoir, and the second distance is greater than the first distance by an amount approximately equal to the first distance.

19. The apparatus of claim 17, wherein the opening of the first chamber is a first distance from the top portion of the common reservoir, the second side of the first chamber is a second distance from the top portion of the common reservoir, the opening of the second chamber is situated at the second distance from the top portion of the common reservoir.

20. The apparatus of claim 1, wherein at least some of the first chamber extends into the common reservoir toward the top portion further than any portion of the second chamber extends into the common reservoir.

* * * * *